United States Patent [19]

Hanan

[11] 4,141,453

[45] Feb. 27, 1979

[54] EARRING DISPLAY RACK

[76] Inventor: Abraham Hanan, P.O. Box 88 G.P.O., New York, N.Y. 10001

[21] Appl. No.: 841,021

[22] Filed: Oct. 11, 1977

[51] Int. Cl.[2] ..... A47F 7/02

[52] U.S. Cl. ..... 211/163; 211/13

[58] Field of Search ..... 211/163, 166, 13, 53, 211/56, 58, 70, 77, 78, 95, 115, 129, 131, 144, 123, 124; 206/564–566

[56] References Cited

U.S. PATENT DOCUMENTS

| | | | |
|---|---|---|---|
| 943,454 | 12/1909 | Pecoy | 211/131 |
| 1,259,623 | 3/1918 | Herrick | 211/166 |
| 2,639,820 | 5/1953 | Lee | 211/163 |
| 3,202,297 | 8/1965 | Hardy | 211/163 |
| 3,489,289 | 1/1970 | Scott-Fenton | 211/78 |

*Primary Examiner*—Roy D. Frazier
*Assistant Examiner*—Terrel P. Lewis
*Attorney, Agent, or Firm*—Kirschstein, Kirschstein, Ottinger & Cobrin

[57] ABSTRACT

A knock-down earring display rack of specific dimensions and structure including a freely rotatable upper spider having a hub and a plurality of spokes extending radially outwards from the hub. The spider is mounted on a post which extends downwards to a base member. The hub of the spider is freely rotatably mounted proximately to the upper end of the post so that the spider can be manually turned on the post about its central axis and so that the spider is generally parallel to the base member. Each spoke of the spider is evenly tapered from a wide inner end to a narrow outer end. The upper edge of each spoke is generally perpendicular to the post and a plurality of notches of specific configuration are spaced along this upper edge. The upper gap in each notch is large enough to at least accommodate an earring post or clasp or wire of an earring.

53 Claims, 7 Drawing Figures

FIG. 2
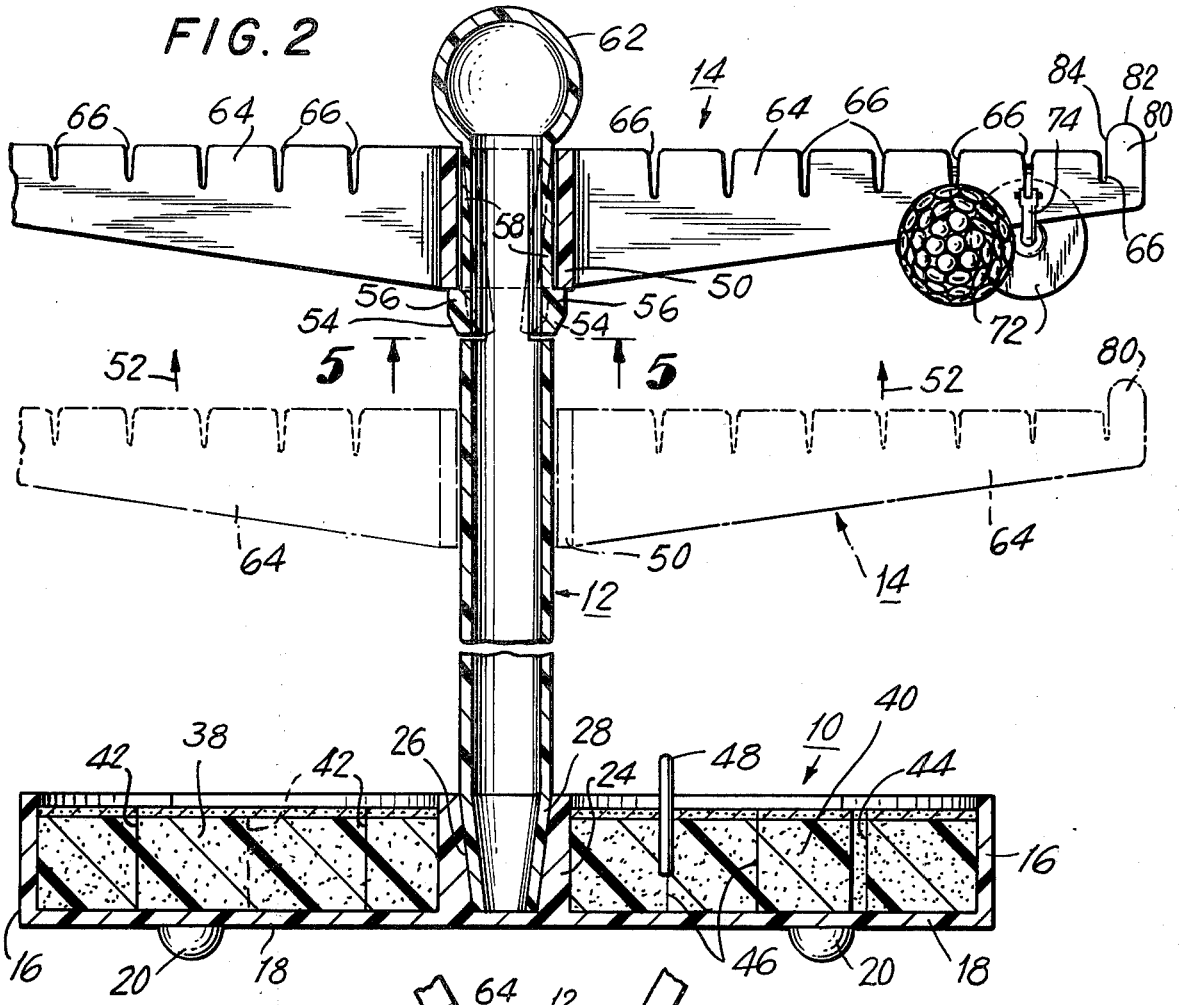
FIG. 5
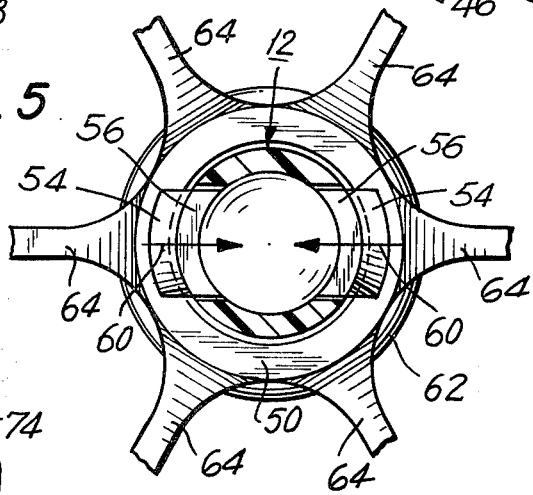
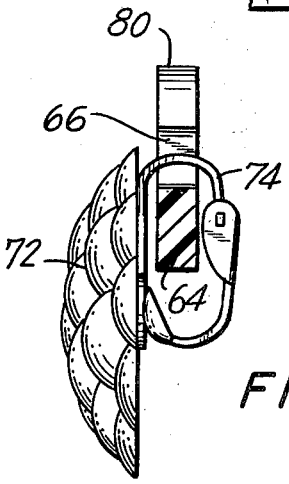
FIG. 6
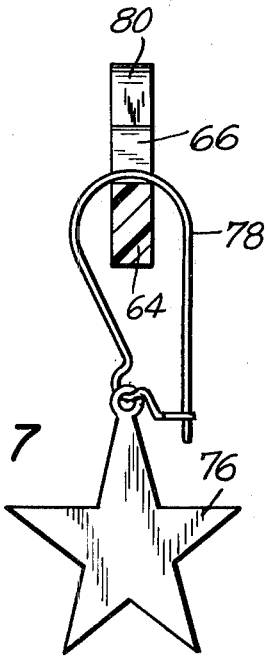
FIG. 7

EARRING DISPLAY RACK

BACKGROUND OF THE INVENTION

1. Field of the Invention

An earring display rack.

2. Description of the Prior Art

This display of collected earrings and/or other jewelry is practiced not only in commerce and trade where such items are offered for sale, but also in the home where a woman's prized possessions of jewelry such as earrings, pendants, ropes, chains, and rings are often arrayed on a display rack, carousel or ladder, not only for ease in selection of a piece of jewelry suitable for the occasion but also for the viewing by visitors to the home, especially other women who thus tend to admire the jewelry and to emulate the owner of such prized possessions. Thus jewelry display racks and in particular earring display racks are often to be found not only in the jewelry trade, i.e. in wholesale jewelry companies and jewelry shops, but also in the home. The prior art configurations of earring display racks are generally not of a knock-down design, i.e. they cannot be readily packaged and shipped in knock-down form for easy assembly at the point of use, and in addition prior art units do not provide a freely rotatable support member for the earrings, which latter feature enables easy viewing of all of the earrings on the rack for ease in selection of an appropriate pair of earrings. In prior art jewelry boxes, the items and pieces of jewelry are simply placed in the box in a state of disarray and are piled one on top of the other which results in entanglement causing damage to the jewelry.

SUMMARY OF THE INVENTION

1. Purposes of the Invention

It is an object of the present invention to provide an improved earring display rack.

Another object is to provide an earring display rack which is readily packaged and shipped in knock down form and thereafter readily assembled at point of use.

A further object is to provide an earring display rack having a freely rotatable member on which the earrings are mounted.

An additional object is to provide an earring display rack having components which are readily and cheaply fabricated from plastic or the like.

Still another object is to provide an earring display rack of specific dimensions to facilitate usage and to accommodate earrings of all known designs, i.e. either post, clasp or wire types.

Still a further object is to provide an earring display rack which enables easy viewing of all of the earrings on the rack for ease in selection of an appropriate pair of earrings, by providing a freely rotatable spider on which the earrings are mounted.

These and other objects and advantages of the present invention will become evident from the description which follows.

2. Brief Description of the Invention

In the present invention, the improved earring display rack is characterized by the provision of a base member, a rectilinear post, and a spider in combination. One end of the post is mounted generally at the center of the base member so that the post is erect and generally perpendicular to the base member. The spider constitutes a hub and a plurality of spokes extending radially outwards from the hub. The hub of the spider is freely rotatably mounted proximately to the upper end of the post, so that the spider can be turned on the post about its central axis and so that the spider is generally parallel to the base member. Each of the spokes is evenly tapered from a wide inner end, in terms of height, to a narrow outer end, again in terms of height. The upper edge of each spoke, which upper edge is spaced away from the base member, is generally perpendicular to the post. Each of the spokes has a plurality of notches in this upper edge, which notches are mutually spaced along the upper edge of the spoke. Each of the notches has an upper gap less than about 0.100 inches and large enough to at least accommodate an earring post or clasp or wire of an earring.

The means mounting the one end of the post to the base member preferably entails the provision of a tapered recess at the center of the base member, together with a tapered terminus at the one end of the post. The tapered recess in the base member will typically be at a central hub in the base member, in which case the base member will preferably be provided with a plurality of upper recesses defined by a plurality of radial baffles, each of which radial baffles extending from the central hub to a peripheral upper baffle at the outer edge of the base member. In such instances, typically a layer of felt or foam rubber is disposed in at least one of the sector-shaped recesses. This layer may be either a thin layer at the bottom of a recess or a thick layer, in which latter instance the layer of felt or foam rubber will usually be provided with a plurality of slits or slots to accommodate for rings, bracelets and the like.

Preferably the post is cylindrical and the base member is disc-shaped with a circular perimeter, so that the post, base member and spider are coaxial. An enlargement is preferably provided at the other (upper) end of the post contiguous with the spider, so that the spider, which has been mounted to the post via insertion of the one (lower) end of the post into the central opening in the hub of the spider, followed by sliding the spider upwards along the post, cannot slide off of the other (upper) end of the post. This enlargement is preferably spherical. The means freely mounting the hub of the spider proximately to the other end of the post preferably consists of at least one cantilever-mounted arm on the post, which arm terminates with a shoulder external to the periphery of the post, so that the spider is mountable on the post by extending the post through the hub of the spider until the hub of the spider cams and depresses the arm and shoulder, and is finally engaged by the shoulder when the depressed state of the arm is relieved and the arm returns to its original disposition, and the hub is thus held firmly in position. In a preferred embodiment, the number of cantilever-mounted arms is two, which arms are disposed on opposite sides of the post, each of the arms having a shoulder. Typically each arm is cantilever-mounted by connecting the arm and shoulder to the post by a flexible resilient arm portion parallel to the central axis of the post.

In preferred embodiments, specific dimensioning and configurations of the notches, arms, and other aspects and elements of the earring display rack are provided. Thus typically the notches in each arm are successively deeper towards the post, i.e. the notches on each spoke of the spider are progressively deeper towards the hub of the spider. Preferably each of the notches is tapered to a lower minimum gap of at least about 0.030 inches, and in a preferred embodiment the lower gap of each notch is about 0.050 inches. Any feasible acute angle of taper of the sides of the notches may be provided; preferably, each side of each notch is tapered by an angle of about 5° from the vertical. The depth of each notch is typically in the range of about 0.050 inches to about 0.400 inches, more specifically, the depth of each notch is preferably in the range of about 0.200 inches to about 0.300 inches. Typically the spacing between adjacent notches, center to center, will generally be in the range of about 0.250 inches to about 0.700 inches, and this spacing will preferably be in the range of about 0.500 inches to about 0.600 inches.

A tab will preferably be provided at the outer end of each spoke of the spider. This tabe will extend upwards at the end of the spoke and terminates above the level of the upper edge of the spoke. The purpose of the tab is to prevent earrings which may be inadvertently slid along the upper edge of a spoke from falling off of the spoke, and also to stiffen and strengthen the outer end of the spoke. The upper end of the tab is preferably rounded. In a preferred embodiment, the inner edge of the tab defines the outer wall of the outermost notch in the spoke of the spider.

Generally, the distance from the top of the base member to the upper edge of each spoke will be in the range of from about 4 inches to about 14 inches, or more specifically, in a preferred embodiment, this distance will be at least about 10 inches and up to about 14 inches. Each spoke will generally have a thickness in the range of about 0.0625 inches to about 0.375 inches; in most instances the thickness of each spoke will be less than about 0.125 inches but greater than about 0.0625 inches. Generally the narrow outer end of each spoke has a height in the range of about 0.200 inches to about 0.900 inches; preferably, this height will be in the range of about 0.375 inches to about 0.500 inches.

The present earring display rack provides several salient advantages. The rack is of knock down form and is readily packaged and shipped in the knock down state as separate elements in a unitary package, and there after readily assembled at point of use. The spider of the rack is a freely rotatable member, so that all of the mounted earrings may readily be viewed by simply manually rotating the spider. The elements and components of the rack are readily and cheaply fabricated from any suitable plastic, e.g. polyethylene; polypropylene, especially isotactic polypropylene; polyvinyl chloride, bakelite, methyl methacrylate or other acrylic resin; cellulose acetate; cellulose acetate butyrate; a polyester, or any other suitable material of construction such as a metal, e.g. aluminum or an aluminum alloy which may be anodized to provide a pleasing color and appearance, magnesium or even steel which may be appropriately coated. The present earring display rack, in a preferred embodiment, is of specific configuration and dimensions so as to facilitate usage and to accommodate earrings of all known designs, i.e. either post, clasp or wire types. Because of the easy viewing feature attained by the freely rotatable spider on which the earrings are mounted, the present rack enables ease in selection of an appropriate pair of earrings suitable to the occasion. A salient advantage compared to jewelry boxes is that the pieces cannot become entangled together and hence damage to the jewelry such as earrings is prevented.

The invention accordingly consists in the features of construction, combination of elements and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention:

FIG. 2 is a sectional elevation view of the assembled rack, taken substantially along the line 2 — 2 of FIG. 1;

FIG. 5 is a bottom plan view taken substantially along the line 5 — 5 of FIG. 2;

FIG. 6 is a sectional elevation view taken substantially along the line 6 — 6 of FIG. 1; and FIG. 7 is a sectional elevation view taken substantially along the line 7 — 7 of FIG. 1.

DETAILED DESCRIPTION OF THE PREFERRED EMBODIMENTS

Figure 1:
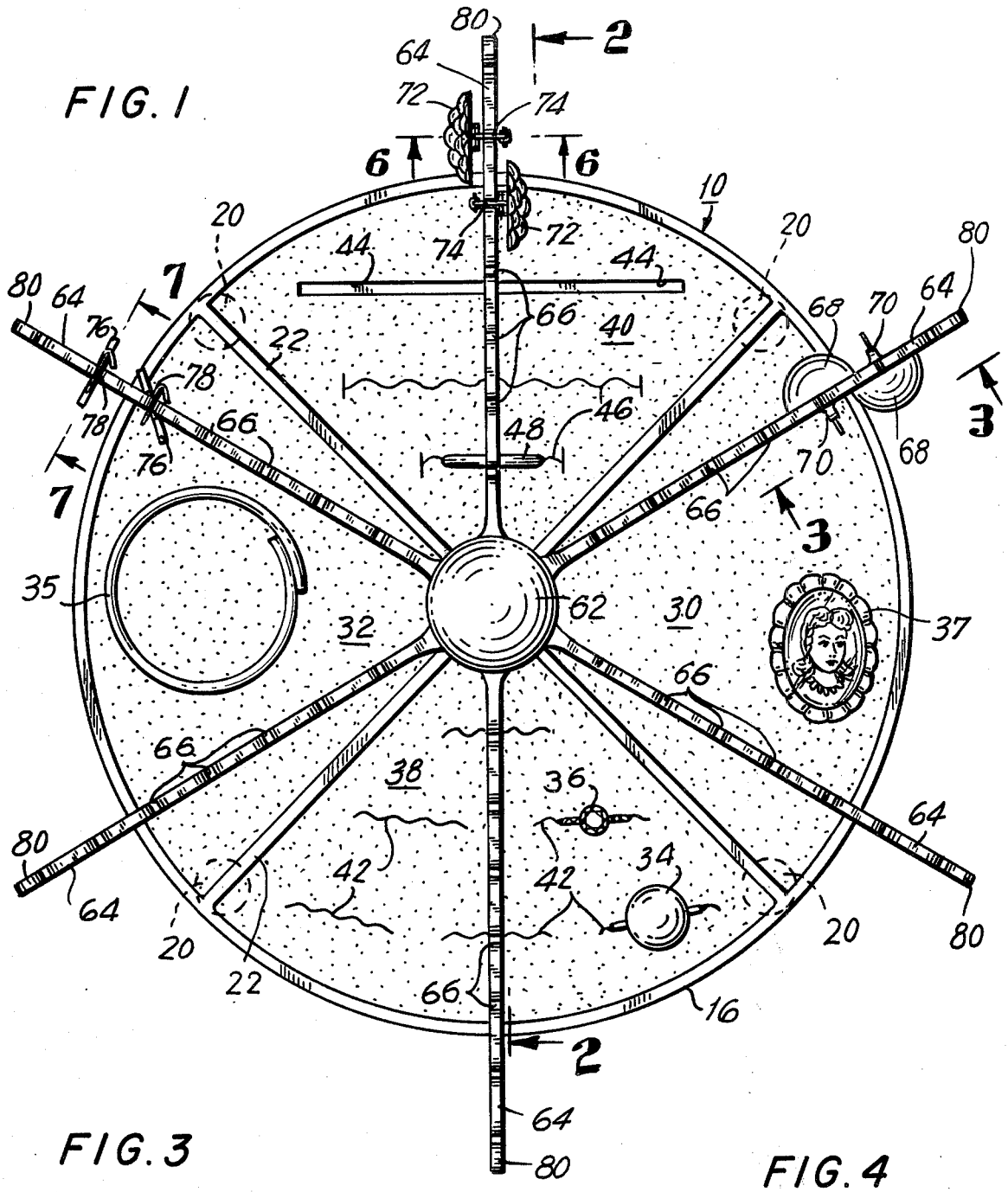
FIG. 1 is an overall plan view of the assembled rack with earrings mounted to the spokes of the spider.

Referring now to FIGS. 1 and 2, the assembled earring display rack basically consists of three elements in combination, namely a disc-shaped circular base member 10, a cylindrical rectilinear post 12 and a spider 14. In the interest of brevity, only the structural aspects and interrelationships of the elements 10, 12 and 14 will be now described; the specific dimensioning aspects of the invention described supra will not be repeated in the description of the drawings infra, however it will be understood that these dimension parameters apply to the subsequent disclosure.

The base member 10 is a generally disc-shaped member with a circular perimeter defined by an upper vertical baffle 16 about its perimeter which is connected at its base to a circular bottom plate 18. Hemispherical protuberances 20 are provided on the bottom of plate 18 so that when the earring display rack is placed on a horizontal surface, the plate 18 will be elevated from the surface. The base member 10 is divided into four sector-shaped portions or recesses by the provision of radial vertical baffles 22 which extend from a central hub 24 in the base member to the annular circular baffle 16. The central hub 24 is characterized by the provision of a tapered recess 26 into which the tapered lower end 28 of the post 12 is fitted, so that the post 12 is vertically oriented and erect, and substantially perpendicular to the horizontal base member 12. The upper surfaces of the sectors 30 and 32 of the base member 10 are covered by a thin layer of felt; a bracelet 35 has been placed in sector 32 and a brooch 37 has been placed in sector 30. The other two sectors 38 and 40 are filled with a thick layer of foam rubber; the foam rubber in sector 38 is provided with a plurality of serrated slits 42 in which rings 34 and 36 may be mounted as shown. The thick foam rubber layer in sector 40 is provided with a slot 44 to accommodate a bracelet or the like, such as the bacelet 35, as well as a plurality of serrated slits 46 into one of which a ring 48 has been vertically inserted.

Referring now to FIGS. 2 and 5, the sequence for mounting the spider 14 proximately to the upper end of the post 12 is shown. Prior to placing the tapered end 28 of the post 12 in the tapered recess 26 in hub 24, the tapered end 28 of the post 12 has been inserted through the central opening in the hub 50 of the spider 14 and the spider 14 has been moved, as shown in phantom outline, in the upwards direction shown by arrows 52 until, as shown in full outline (FIG. 2) the hub 50 has cammed the bevels 54 of shoulders 56 of the cantilever-mounted arms 58 provided adjacent to the upper end of the post 12. The camming action of hub 50 against bevels 54 moves the shoulders 56 of arms 58 inwards and towards each other as indicated by arrows 60 (FIG. 5), so that the arms are depressed and pivoted inwards as shown by the phantom outline in FIG. 2. Thereafter, the hub 50 moves above the shoulders 56 and is engaged by the upper edges of the shoulders 56 and held firmly in place, with the shoulders 56 now being external to the post 12. Thus the hub 50 of the spider 14 is freely rotatably mounted proximately to the upper end of the post 12 so that the spider 14 may be readily manually rotated about its central vertical axis by appropriate manipulation, i.e. lateral force exerted against one or more of the spokes of the spider 14 to be described infra. FIGS. 2 and 5 show the lateral spacing between the post 12 and the hub 50 which permits the freely rotatable mounting of the spider 14 while it is being supported by the now outwardly extended shoulders 56, which have moved outwards due to the spring-like cantilever mounting of the arms 58. The mounting of the hub 50 of the spider 14 on the post 12 is facilitated by providing the cantilever mounting of the arms 58, with the arm 58 and shoulder 56 in each case being connected to the post 12 by an upper flexible resilient arm portion parallel to the vertical central axis of the post 12. The post 12 is completed in this embodiment of the invention by the provision of an upper terminal enlargement 62 which is spherical and which is provided for the reasons discussed supra.

The spider 14 is constituted by the hub 50 and a plurality of spokes 64 which extend radially outwards from the hub 50. The radial configuration of the spokes 64 is best shown in FIG. 1; the hub 50 is disposed below the enlargement 62 in this view. As best shown in FIG. 2, the spider 14 when mounted on the post 12 is substantially parallel to the base member 10. Each of the spokes 64 is evenly tapered from a wide inner end (in terms of height) adjacent hub 50 to a narrow outer end (in terms of height), while at best shown in FIG. 2, the upper edge of each spoke is substantially perpendicular to the post 12 and is provided with a plurality of notches 66 mutually spaced along the upper edge of each spoke 64. As shown in FIG. 2, the notches 66 on each spoke 64 of the spider 14 are progressively deeper towards the hub 50 of the spider 14.

Figure 3:
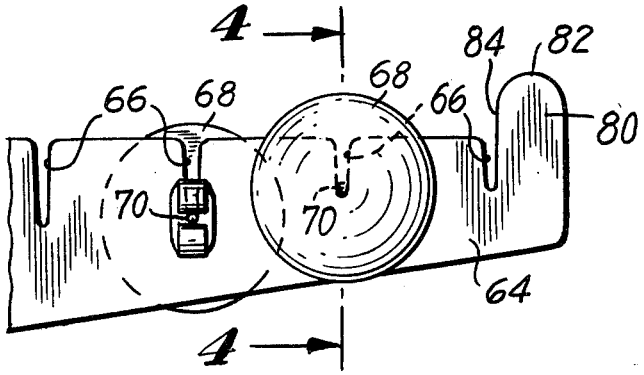
FIG. 3 is a partial elevation view taken substantially along the line 3 — 3 of FIG. 1.
Figure 4:
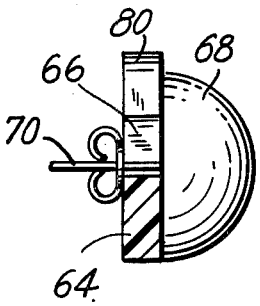
FIG. 4 is a sectional elevation view taken substantially along the line 4 — 4 of FIG. 3.

FIGS. 1, 3 and 4 show how a pair of post type earrings 68, each having threaded or friction type post 70, is accommodated and mounted in a notch 66 of a spoke 64, which notch 66 has a gap which is large enough to accommodate the shank of the post 70.

FIGS. 1, 2 and 6 show how a pair of clasp type earrings 72, each having a pivoted or spring biased clasp 74, is accommodated and mounted in a notch 66 of a spoke 64, which notch 66 has a gap which is large enough to accommodate the arm of the clasp 74.

FIGS. 1 and 7 show how a pair of wire type earrings 76, each having a mounting wire 78, is accommodated and mounted in a notch 66 of a spoke 64, which notch 66 has a gap which is large enough to accommodate the wire 78.

FIGS. 2 and 3 best show a tab 80 which is provided at the outer end of each spoke 64 of the spider 14. The tab 80 extends upwards at the end of each spoke 64 and terminates above the level of the upper edge of the spoke 64. The upper end 82 of the tab 80 is shown as being rounded (see FIGS. 2 and 3). The inner edge 84 of the tab 80 defines the outer wall of the outermost notch 66 in the spoke 64 of the spider 14.

It thus will be seen that there provided an earring display rack as an article of manufacture which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An earring display rack comprising a base member, a rectilinear post, means mounting one end of said post substantially at the center of said base member, said means comprising a tapered recess at the center of the base member, together with a tapered terminus at the one end of the post, so that said post is erect and substantially perpendicular to said base member, said tapered recess in the base member being at a central hub in the base member, the base member having a plurality of upper recesses defined by a plurality of radial baffles, each of said radial baffles extending from said central hub in the base member to a peripheral upper baffle at the outer edge of the base member, so that a plurality of sector-shaped upper recesses are provided in the upper surface of the base member, each sector-shaped upper recess being defined by two adjacent radial baffles and a portion of said peripheral upper baffle, and a spider constituting a hub and a plurality of spokes extending radially outwards from the hub, means freely rotatably mounting the hub of said spider proximately to the upper end of said post so that said spider can be turned on said post about its central axis and so that said spider is substantially parallel to said base member, each of said spokes being evenly tapered from a wide inner end to a narrow outer end, with the upper edge of each spoke which is spaced away from said base member being substantially perpendicular to said post, each of said spokes having a plurality of notches in said edge and mutually spaced along the same, each of said notches having an upper gap less than about 0.100 inches and large enough to at least accommodate an earring post or clasp or wire of an earring.

2. The earring display rack of claim 1 in which a layer of felt or foam rubber is disposed in at least one of the sector-shaped recesses.

3. The earring display rack of claim 1 in which the post is cylindrical and the base member is disc-shaped with a circular perimeter.

4. The earring display rack of claim 1 in which an enlargement is provided at the other end of the post.

5. The earring display rack of claim 4 in which the enlargement is spherical.

6. The earring display rack of claim 1 in which the means freely mounting the hub of the spider proximately to the other end of the post comprises at least one cantilever-mounted arm on the post, said arm terminating with a shoulder external to the post, so that the spider is mountable on the post by extending the post through the hub of the spider until the hub of the spider cams and depresses said arm and is subsequently engaged by said shoulder as said arm subsequently is relieved from its depressed disposition with the base of the hub being seated on said shoulder.

7. The earring display rack of claim 6 in which the number of cantilever-mounted arms is two, said arms being on opposite sides of the post, each of said arms having a shoulder.

8. The earring display rack of claim 6 in which the arm is cantilever-mounted by connecting the arm and shoulder to the post by a flexible resilient arm portion parallel to the central axis of the post.

9. The earring display rack of claim 1 in which the notches in each spoke are successively deeper towards the post.

10. The earring display rack of claim 1 in which each of the notches is tapered to a lower minimum gap of at least about 0.030 inches.

11. The earring display rack of claim 10 in which the lower gap of each notch is about 0.050 inches.

12. The earring display rack of claim 10 in which each side of each notch is tapered by an angle of about 5° from the vertical.

13. The earring display rack of claim 1 in which the depth of each notch is in the range of about 0.050 inches to about 0.400 inches.

14. The earring display rack of claim 13 in which the depth of each notch is in the range of about 0.200 inches to about 0.300 inches.

15. The earring display rack of claim 13 in which the notches on each spoke of the spider are progressively deeper towards the hub of the spider.

16. The earring display rack of claim 1 in which the spacing between adjacent notches is in the range of about 0.250 inches to about 0.700 inches.

17. The earring display rack of claim 16 in which the spacing between adjacent notches is in the range of about 0.500 inches to about 0.600 inches.

18. The earring display rack of claim 1 in which a tab is provided at the outer end of each spoke of the spider, said tab extending upwards at the end of the spoke and terminating above the level of the upper edge of the spoke.

19. The earring display rack of claim 18 in which the upper end of the tab is rounded.

20. The earring display rack of claim 18 in which the inner edge of the tab defines the outer wall of the outermost notch in the spoke of the spider.

21. The earring display rack of claim 1 in which the distance from the top of the base member to the upper edge of each spoke is in the range of from about 4 inches to about 14 inches.

22. The earring display rack of claim 21 in which the distance from the top of the base member to the upper edge of each spoke is at least about 10 inches.

23. The earring display rack of claim 1 in which each spoke has a thickness in the range of about 0.0625 inches to about 0.375 inches.

24. The earring display rack of claim 23 in which the thickness of each spoke is less than about 0.125 inches.

25. The earring display rack of claim 1 in which the narrow outer end of each spoke has a height in the range of about 0.200 inches to about 0.900 inches.

26. The earring display rack of claim 25 in which the narrow outer end of each spoke has a height in the range of about 0.375 inches to about 0.500 inches.

27. An earring display rack comprising a base member, a rectilinear post, means mounting one end of said post substantially at the center of said base member so that said post is erect and substantially perpendicular to said base member, and a spider constituting a hub and a plurality of spokes extending radially outwards from the hub, means freely rotatably mounting the hub of said spider proximately to the upper end of said post so that said spider can be turned on said post about its central axis and so that said spider is substantially parallel to said base member, said member freely mounting the hub of the spider proximately to the other end of the post comprising at least one cantilever-mounted arm on the post, said arm terminating with a shoulder external to the post, so that the spider is mountable on the post by extending the post through the hub of the spider until the hub of the spider cams and depresses said arm and is subsequently engaged by said shoulder as said arm subsequently is relieved from its depressed disposition with the base of the hub being seated on said shoulder, each of said spokes being evenly tapered from a wide inner end to a narrow outer end, with the upper edge of each spoke which is spaced away from said base member being substantially perpendicular to said post, each of said spokes having a plurality of notches in said edge and mutually spaced along the same, each of said notches having an upper gap less than about 0.100 inches and large enough to at least accommodate an earring post or clasp or wire of an earring.

28. The earring display rack of claim 27 in which the number of cantilever-mounted arms is two, said arms being on opposite sides of the post, each of said arms having a shoulder.

29. The earring display rack of claim 27 in which the arm is cantilever-mounted by connecting the arm and shoulder to the post by a flexible resilient arm portion parallel to the central axis of the post.

30. The earring display rack of claim 27 in which the means mounting the one end of the post to the base member comprises a tapered recess at the center of the base member, together with a tapered terminus at the one end of the post.

31. The earring display rack of claim 30 in which the tapered recess in the base member is at a central hub in the base member, the base member having a plurality of upper recesses defined by a plurality of radial baffles, each of said radial baffles extending from said central hub in the base member to a peripheral upper baffle at the outer edge of the base member, so that a plurality of sector-shaped upper recesses are provided in the upper surface of the base member, each sector-shaped upper recess being defined by two adjacent radial baffles and a portion of said peripheral upper baffle.

32. The earring display rack of claim 31 in which a layer of felt or foam rubber is disposed in at least one of the sector-shaped recesses.

33. The earring display rack of claim 27 in which the post is cylindrical and the base member is disc-shaped with a circular perimeter.

34. The earring display rack of claim 27 in which an enlargement is provided at the other end of the post.

35. The earring display rack of claim 34 in which the enlargement is spherical.

36. The earring display rack of claim 27 in which the notches in each spoke are successively deeper towards the post.

37. The earring display rack of claim 27 in which each of the notches is tapered to a lower minimum gap of at least about 0.030 inches.

38. The earring display rack of claim 37 in which the lower gap of each notch is about 0.050 inches.

39. The earring display rack of claim 37 in which each side of each notch is tapered by an angle of about 5° from the vertical.

40. The earring display rack of claim 27 in which the depth of each notch is in the range of about 0.050 inches to about 0.400 inches.

41. The earring display rack of claim 40 in which the depth of each notch is in the range of about 0.200 inches to about 0.300 inches.

42. The earring display rack of claim 40 in which the notches on each spoke of the spider are progressively deeper towards the hub of the spider.

43. The earring display rack of claim 27 in which the spacing between adjacent notches is in the range of about 0.250 inches to about 0.700 inches.

44. The earring display rack of claim 43 in which the spacing between adjacent notches is in the range of about 0.500 inches to about 0.600 inches.

45. The earring display rack of claim 27 in which a tab is provided at the outer end of each spoke of the spider, said tab extending upwards at the end of the spoke and terminating above the level of the upper edge of the spoke.

46. The earring display rack of claim 45 in which the upper end of the tab is rounded.

47. The earring display rack of claim 45 in which the inner edge of the tab defines the outer wall of the outermost notch in the spoke of the spider.

48. The earring display rack of claim 27 in which the distance from the top of the base member to the upper edge of each spoke is in the range of from about 4 inches to about 14 inches.

49. The earring display rack of claim 48 in which the distance from the top of the base member to the upper edge of each spoke is at least about 10 inches.

50. The earring display rack of claim 27 in which each spoke has a thickness in the range of about 0.0625 inches to about 0.375 inches.

51. The earring display rack of claim 50 in which the thickness of each spoke is less than about 0.125 inches.

52. The earring display rack of claim 27 in which the narrow outer end of each spoke has a height in the range of about 0.200 inches to about 0.900 inches.

53. The earring display rack of claim 52 in which the narrow outer end of each spoke has a height in the range of about 0.375 inches to about 0.500 inches.

* * * * *